United States Patent [19]

Ward

[11] Patent Number: 4,677,960

[45] Date of Patent: Jul. 7, 1987

[54] HIGH EFFICIENCY VOLTAGE DOUBLING IGNITION COIL FOR CD SYSTEM PRODUCING PULSED PLASMA TYPE IGNITION

[75] Inventor: Michael A. V. Ward, Lexington, Mass.

[73] Assignee: Combustion Electromagnetics, Inc., Arlington, Mass.

[21] Appl. No.: 688,030

[22] Filed: Dec. 31, 1984

[51] Int. Cl.[4] ..... F02P 3/08; F02P 15/08; H01F 27/30

[52] U.S. Cl. ..... 123/598; 123/634; 123/637; 336/96

[58] Field of Search ..... 123/606, 597, 598, 637, 123/634, 143 B, 596; 315/209 R, 209 T; 336/96, 182, 185

[56] References Cited

U.S. PATENT DOCUMENTS

| | | | |
|---|---|---|---|
| 2,840,623 | 6/1958 | Middleton | 123/634 |
| 3,566,202 | 2/1971 | Carr | 336/84 X |
| 4,149,508 | 4/1979 | Kirk, Jr. et al. | 123/606 X |
| 4,291,661 | 9/1981 | Gerry | 123/606 |
| 4,369,758 | 1/1983 | Endo | 123/606 X |
| 4,554,486 | 11/1985 | Gerry | 315/209 R |

FOREIGN PATENT DOCUMENTS

| | | | |
|---|---|---|---|
| 2339734 | 3/1975 | Fed. Rep. of Germany | 123/634 |
| 73246 | 6/1977 | Japan | 123/634 |

*Primary Examiner*—Tony M. Argenbright
*Attorney, Agent, or Firm*—Jerry Cohen

[57] ABSTRACT

A capacitive discharge pulsed plasma ignition system which is suitable for retrofitting to standard automobile engines, and easily adaptable to new engines, including diesel engines, which has been substantially improved by using a novel ultra-high efficiency ignition transformer (coil) (3) with an optimized high current and high voltage output. The ignition is preferably used with a high pulse rate, high efficiency, multiple pulse ignition box providing rapid pulsed plasma ignition sites. The coil (3) has a low winding turns ratio of about 40, low primary (1,11) and secondary (2,12) inductances and resistances, low loss in its core (3*a*), low secondary capacitance (5), and is used in conjunction with a capacitor (4) of capacitance between 1 and about 20 microfarads. The system uses voltage doubling at the spark gap (9) through coil/capacitor design combination to fire a wide spark gap (9) and provide a very high current. The spark current has a high spark energy and long effective duration through rapid pulsing at a high duty cycle of the spark gap (9) with the pulse rate chosen to optimize ignitability for any engine system. When the high efficiency coil (3) and capacitor (4) are thus used, a practical, easily installed, low cost, ultra-high efficiency optimized "pulsed plasma" ignition system is provided capable of producing ignition of very lean mixtures for substantially reduced exhaust emissions and increased engine efficiency.

34 Claims, 7 Drawing Figures

HIGH EFFICIENCY VOLTAGE DOUBLING IGNITION COIL FOR CD SYSTEM PRODUCING PULSED PLASMA TYPE IGNITION

CROSS REFERENCE TO RELATED APPLICATION

This application is related to the copending application of Ward and Lefevre filed of even date herewith and commonly assigned, Ser. No. 688,036.

BACKGROUND OF THE INVENTION AND PRIOR ART

The present invention comprises an optimal and versatile spark ignition system based on an optimally designed voltage doubling, low turns ratio, ultra-high efficiency ignition coil of low output capacitance coupled to a large input capacitor, providing simultaneous high breakdown voltage and high spark current at optimal spark oscillation frequency. The invention is usable in any of simple spark, multi pulse, plasma jet, or multi pulse plama jet modes. Preferably the invention is used in conjunction with simple design, versatile, high efficiency, high pulse rate, multi-pulse capacitive discharge (CD) electronic ignitions, permitting optimization with respect to the spark plasma pulse rate.

A principal purpose of the invention, designated as Pulsed Plasma Ignition, or Pulsed Ignition, is to provide a simply incorporated and retrofitable ignition system which will allow internal combustion (IC) engines to operate under very lean air-fuel ratio mixture conditions for the highest efficiency and lowest exhaust emissions. For the additional case of Diesel engines (Direct Injection (DI) engines) the system will provide effective ignition of the fuel for reduced ignition delay time and more controlled combustion. These advantages are provided by Pulsed Ignition's ability to fire wide gaps and produce high arc current (desired for lean burn engines but heretofore considered impractical).

Current ignition and combustion related equipment are either ineffective or impractical for allowing engines to operate at the 22:1 air-fuel ratio necessary to meet the presently contemplated moderately strict European emission standards. In the U.S. for example, where emission standards have been in force for many years, the rich mixture (14.6:1 air-fuel ratio) three-way catalyst system is exclusively used for gasoline engines.

The conventional Kettering (inductive) ignition system is ineffective in providing ignition of mixtures leaner than about 18:1. Electronic ignition and Capacitive Discharge (CD) ignition are no better as they use the same extremely inefficient ignition coil and provide minimal ignition energy (electrical currents) to the spark. While existing multiple pulse ignition systems, such as U.S. Pat. No. 3,898,971, are superior to these, they suffer from still providing low spark currents and have a low overall efficiency, even when used with the more efficient pulse transformer ignition coil, and provide only slightly better lean mixture ignition properties. They provide substantially the same ignition currents (approximately 100 milliamps) although higher overall energy through multiple pulse sparking. However, the time between pulses is low—too low to be useful at anything but low RPM, and of marginal use in Direct Injection engines where the typical fuel injection time is one to two milliseconds.

In an attempt to substantially increase ignition energy and ignition system efficiency, a class of ignition systems called "plasma jet" was developed, such as U.S. Pat. Nos. 4,122,816 and 4,317,068. These systems were developed under the assumption that standard high voltage ignition coils are inherently inefficient and ineffective for transferring ignition energy to a spark gap, and the energy must be provided by an alternative means. While they provide this alternative means and improved ignition, they are substantially more complex, they require special more complex spark plugs, and suffer from a serious spark plug erosion problem. Furthermore, since they need to fire multiple spark gaps or require expensive high voltage/high current diodes, they are less practical and more difficult to use in lean burn engines, high compression ratio engines, and spark ignited diesel engines.

Other systems fall between these various categories, and fail to address and answer the fundamental questions of providing successful ignition by using the characteristics inherent in ignition coils when specifically coupled to high efficiency high pulse rate multi-pulse capacitive discharge ignition systems—to provide rapid firing wide gap high current plasma jet-like sparks.

OBJECTS OF THE INVENTIONS

It is the principal object of this invention to use the inherent transient voltage doubling characteristic of a transformer (ignition coil) in conjunction with a CD circuit to provide a low turns ratio ignition coil which exhibits both high output voltage and high current at an unusually high energy transfer efficiency.

It is another object of this invention to use this coil with high efficiency, high pulse rate multiple pulse ignition circuits to optimize the invention ignition characteristics with respect to pulse rate, while maintaining system simplicity and very high operating efficiency.

Another object of this invention is to provide an ignition system capable of firing a wide spark plug gap, of providing high ignition current with an optimized high oscillation frequency, and a long effective ignition duration through rapid firing of multiple ignition pulses.

Another object of this invention is to provide the spark plasma and pulse rate optimal ignition system characteristics in a simple, easily incorporated and retrofitable system, composed of a combination ignition coil with a single unit ignition power supply/control box.

Another object of this invention is to provide an ignition coil voltage doubling optimization criterion and coil efficiency optimization criterion (when usedd in a CD configuration), so that coil inductance, turns ratio, resistance, and input and output coupled capacitance can be selected for optimization according to these criteria. In this way an optimization methodology is provided.

Another object is to combine the voltage and efficiency optimization criteria, the rapid pulse rate conditions, and known electrical conditions at the spark gap to provide a power supply optimization criterion in conjunction with an ignition pulse duty cycle specification (between 20% and 50% duty cycle).

Another object is to provide rapid firing pulses with optimized spark plasma frequency characteristics of 10 to 30 Khz at an optimized time between pulses of 0.05 to 0.5 milliseconds, and a high pulsing duty cycle of about 20% to 50%, where pulsing duty cycle equals ignition pulse period divided by sum of the pulse period and no pulse period.

Another objective is to provide a coil design with a simple cylindrical shape and a sectioned secondary winding to provide the coil voltage doubling feature and high efficiency along with a very low output capacitance and simple and practical coil shape and size.

Another objective is to provide a spark plug tip design which utilizes the advantages of the wide gap/high current capabilities of the Pulsed Ignition system, the tip characterized by extended straight parallel electrodes for producing a wide spark gap and maximum magnetic field for moving the pulsed high current spark gap plasma outwards and into the air-fuel mixture.

Other features and advantages will be pointed out hereinafter, and will become apparent from the following discussion including a Summary of the invention and Description of Particular Preferred Embodiments of the invention when read in conjunction with the accompanying drawings.

SUMMARY OF THE INVENTION

This invention comprises a novel low turns ratio ignition coil with a low secondary inductance and capacitance, low primary and secondary resistance, and low core loss, used in a "voltage doubling" mode in conjunction with a simple design, high efficiency capacitive discharge ignition system. The invention includes recognition of how to use the "voltage doubling" mode, which is overlooked in the prior art, especially as a high pulse rate and high duty cycle multiple pulse ignition (MPI) system. In this combination it provides an optimized ignition system with an ultra-high efficiency.

The unusual feature of this coil/capacitor invention is its ability to simultaneously, and easily and efficiently, provide very high output voltage (e.g. 36 kilovolts), high spark current (2–20 amps), and optimal spark plasma oscillation frequency (10–30 kiloHertz) in a simple, inexpensive, compact ignition coil and 380 volt power supply/control box. It can provide large (e.g. 0.10 inch spark gap), full sine wave, moving plasma jet-like discharge (10–20 amps), or very rapid firing, large gap, high current pulses (e.g. 2–5 amps every 100 microseconds), or any of a range of voltage/current/oscillation/pulse-rate as is necessary to optimize ignition in modern high efficiency lean burn engines, and high speed or fast burn engines. In essence, the system of the invention provides an unprecedented combination of very high current-voltage-frequency output/high efficiency/great versatility/simple design/low cost.

The coil features moderately low primary and low secondary inductances L1 and L2, very low primary and secondary resistances R1 and R2, low core losses, very low secondary capacitance C2', high coil coupling coefficient k, and low turns ratio N of 15–60. The coil resistances and turns ratio are chosen such that the "coil efficiency parameter" EP is chosen approximately equal to the spark (or arc) voltage constant K.

The coil is coupled to a capacitive discharge ignition with an ignition capacitance C1 of 1–20 microfarads, such that the novel "coil coupled capacitance voltage doubling parameter" VP is close to two, preferably between 1.8 and 2.0. When used in this way, the coil exhibits an output voltage almost double that of existing ones, allowing for a reduced turns ratio at least one third the usual, and complete coil redesign to provide several amps of secondary current at efficiencies in the range of 25% to 60%, versus tens to hundreds of milliamps at 1% to 10% efficiency for existing coils, including pulse transformers.

The capacitor-coupled coil also exhibits a secondary current oscillation in the frequency range of 10 to 30 KiloHertz, a range of frequency believed to be optimal for ignition in a spark gap of width 0.040" to 0.080".

The Pulsed Plasma Ignition preferably operates in a multiple pulse mode at a high pulse rate of several pulses per millisecond and a duty cycle in the range of 20% to 50% (for the above pulse oscillation frequency of 10–30 KiloHertz). The Pulsed Ignition system preferably uses power supply control features which allow it to operate at a very high efficiency. These include power supply turn-off during firings and output voltage sensing and feedback to closely regulate output voltage (and optimize power supply efficiency and coil design). Preferably a reduction of number of pulses per ignition with engine speed is provided, compensating in part for the increased number of ignition firings with engine speed.

When an optimized power supply and control box is coupled with the optimized ignition coil, one obtains an ignition (Pulsed Ignition) system with unprecedented efficiency, great simplicity and igniting ability and which is easily retrofitable on existing automobile engines. Its igniting capability is comparable to plasma jet, and it will allow an automobile engine to operate at the 22:1 air-fuel (AF) ratio necessary to meet contemplated European emission standards and provide a twenty to thirty percent efficiency improvement over three-way catalyst engines (through its lean combustion operation).

BRIEF DESCRIPTION OF THE DRAWINGS

The nature and objects of the invention are illustrated and described with reference to the following drawings, which also illustrate the preferred embodiments of the invention.

DESCRIPTION OF PREFERRED EMBODIMENTS

Figure 1:
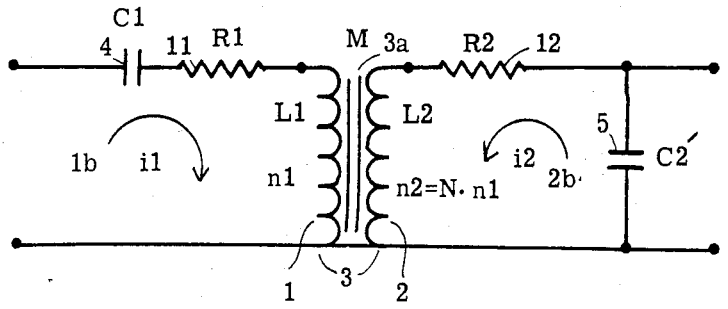
FIG. 1 depicts the preferred embodiment of the optimized coil invention in terms of the various parameters that make up the voltage VP and efficiency EP optimization criteria. These parameters include the input charge storage capacitor C1 used in combination with the coil parameters for optimized coil use in a CD configuration.

FIG. 1 depicts the optimized ignition coil 3 connected to an input capacitor 4 used in combination to attain the novel optimal ignition system characteristics. The coil primary winding 1 of turns n1 is coupled to the secondary winding 2 of turns n2 via the coupling core 3*a* through a mutual inductance M. The turns ratio is N, where $N=n2/n1$. The secondary coil winding intrinsic capacitance 5 to ground is represented by C2'. The coil primary winding 1 has an inductance value L1 and a resistance 11 value R1; the secondary winding 2 has inductance value L2 and a resistance 12 value R2.

For purpose of specification of the various parameters and to facilitate the disclosure, the following definitions are made:

"equal to X" implies X+ or −10%;

"approximately equal to X" implies X+ or −20%;

"about equal to X" implies X+ or −50%.

The novel features of the coil are the optimization criteria based on the parameters defined below:

The coil voltage doubling parameter $$VP=2/[1+(C2*L2)/(C1*L1)]=2/[1+(N**2)*C2/C1]$$

The coil efficiency parameter $$EP=[(R2+N**2*R1)*(I2)**3/2]/K=[(R)*(I2)**3/2]/K$$

where $L2/L1=N**2$,

I2 is the peak of the secondary circuit (2*a*) current i2, $R=(R2+N**2*R1)$ is the "through resistance", $K=1.4*Varc*(I2)**\frac{1}{2}$ is the arc characteristic constant in volt-amps equal to between 60 and 150 for typical spark gaps at the elevated pressures found in typical IC engines.

The primary circuit 1*a* time dependent and peak currents are i1 and I1 respectively. The notation "*" and "**" represent multiplication and exponentiation respectively.

The coil optimization criteria are given below and are derived with respect to FIGS. 1 and 2:

VP=1.8 to 2.0, i.e. VP is equal to and less than 2;

EP=1 or less.

It is through use of these criteria, i.e. by being forced to strictly adhere to these criteria or constraints that the optimal novel ignition coil is developed. Other parameters that must be specified are the primary and secondary peak voltage, and desired range of arc current and its oscillation frequency (which are interelated to varying degrees).

For example, these criteria imply automotive ignition coil design contrary to existing designs, leading to very low turns ratio N about equal to 40 (20–60) and a coil through resistance R about equal to 100 ohms (for peak secondary current I2 approximately equal to 1 amp). On the other hand, automotive ignition coils have a turns ratio N of 100 to 130 (200 to 250 for electronic ignition) according to E. F. Obert, "Internal Combustion Engines and Air Pollution", Intext Educational Publishers, N.Y., N.Y., 1973. Typical through resistance R is 50,000 ohms. Pulse transformers have N typically equal to 80 and R equal to 1,500.

In the circuit of FIG. 1, the electrical energy is stored in capacitor 4 of capacitance C1 in the range of 1 to 20 microfarads available for transfer to secondary circuit 2*b* by means of coil 3 through inductive coupling of mutual inductance M, to produce a high voltage in 2*b* for ignition or other purposes.

While the best application for the coil invention is a CD circuit, the coil will also operate with standard or electronic ignition excepting that full advantage cannot be taken of the high current/voltage capabilities of the coil since these ignitions cannot store high energy rapidly. In standard and electronic ignition the capacitor across the points takes the role of capacitor C1.

Figure 2:
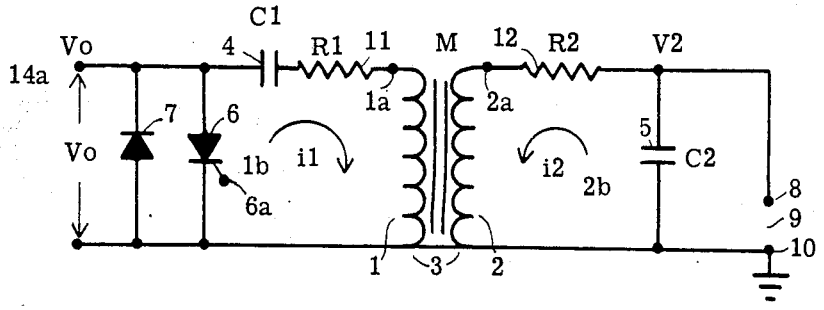
FIG. 2 depicts the simplest preferred coil/capacitor combination circuit including input circuit with switching SCR means and output spark gap means. The circuit represents the condition both prior to and after electrical breakdown of the spark gap. The circuit includes the energy storage capacitor C1 in the primary side making up the capacitive discharge feature, and the total output capacitance C2 of the coil secondary circuit including spark plug wire and the plug itself.

FIG. 2 depicts the coil 3/capacitor 4 combination of FIG. 1 used in a capacitor discharge ignition configuration under the conditions both prior to electrical gap 9 (ignition) breakdown and during breakdown. The switching device that initiates the ignition (the discharge of capacitor 4) is SCR 6, across which diode 7 is placed to provide reverse current for a complete current/voltage oscillation.

Initially capacitor 4 is charged to voltage V0, and when SCR 6 receives a trigger, it conducts and pulls point 14*a* to ground potential 10, raising point 1*a* of primary winding 1 to V1 (equal to V0) and point 2*a* to V2. Voltage V2 is then impressed across spark gap 9 defined by electrodes 8 and 10, where 10 is typically maintained at ground potential. It is then assumed by others that point 2*a* rises to a voltage V2 given approximately by N*V1, i.e. by the product of the winding ratio and initial primary side voltage.

V2 in fact rises to a voltage determined by the solution of coupled second order differential equations based on this circuit. These equations were solved with the proper specification of the initial values, to give:

$$V2(t)=k1*N*V1*[\cos W2t-1]/[1+(N**2)*C2/C1]$$

which gives a maximum value of:

$$V2=k1*N*V1*VP$$

where $VP=2/[1+C2*L2/C1*L1]=2/[1+(N**2)*C2/C1]$ $VP=2/[1+DF]$, $DF=(N**2)*C2/C1$ $k1=(M/L1)/N$, $W2=SQRT[(1+DF)/(L2*C2*(1-k**2))]$, $k2=(M/L2)*N$, and $k=SQRT[k1*k2]=M/SQRT[L1*L2]$ k, and k1 and k2, are the coil coupling parameters which are typically in the range of 0.98–0.995 for well designed coil, and W2 is the characteristic angular frequency with which the voltage V2 rises and oscillates.

The key feature here is the appearance of the term VP on the right hand side of the above equation representing a potential "voltage doubling" of V2 attained through the "doubling factor DF" defined above, i.e. the potential to achieve twice the voltage V2 than is normally obtained.

For a typical automotive ignition coil (used in a capacitive discharge ignition application):

N=100, C1=1 microfarad, C2=100 picofarad, which implies that:

DF=1,

VP=1 which precisely cancels out the voltage doubling factor. It is this fortuitous circumstance (exact cancellation of the voltage doubling factor) that has contributed in part to the lack of discovery, appreciation of, and utilization of the "voltage doubling" factor—despite a long history of over fifty years of widespread use of ignition coils in practically all automotive IC engines.

Based on this understanding, an optimized ignition coil is proposed with the following characteristics:

N about equal to 40 (20–60);

Cl between 1 and 20 microfarads in general, and for the specific application of conventional lean burning IC engines:

C1 about equal to 4 microfarads (2–6 ufarads).

C2′ less than 40 picofarads, where C2′ generally makes up half or less of the total secondary circuit 2*b* output capacitance 5 (C2). Preferably:

C2′ about equal to 20 picofarads (10–30 pf).

Typically C2′ stores a significant portion of the ignition energy which upon discharge creates the capacitive component of the spark, made up of extremely high frequency oscillations (megaHertz range) at high currents. This component is not believed to be as important as the inductive current component, to be described, in causing ignition of lean mixtures, and produces undesirable Radio Frequency Interference (RFI). Therefore C2′ is made very small by special winding of the coil (as in FIG. 3).

Complete specification of the novel optimized coil can be made after other key factors have been taken into account, principally those related to input and output voltage requirements, desired spark current and duration (oscillation frequency). and power supply capability. When used in conjunction with a well designed power supply and controller, some refinement of the specification will occur.

FIG. 2 also represents the condition immediately after electrical breakdown of gap 9 and formation of arc or spark in the gap. Through the analysis of this circuit under this arcing condition, most of the remaining specification can be made, in terms of electrical efficiency optimization and other factors.

The quantity that must be solved here is the current i2 in gap 9 of circuit 2*b* arising from discharge of the energy stored in capacitor 4. The energy is transferred by transformer action provided by coil 3, and is determined once again through the solution of coupled second order differential equations with appropriate initial values. This was performed to give the following expression for the current:

$$i2(t)=k2*V1*\sin W1t/[N*SQRT(1-k**2)*SQRT(L1/C1)]$$

which gives a maximum value of:

$$I2=k2*V1/[N*SQRT(L1E/C1)]$$

where $$W1=1/SQRT[L1E*C1]$$

$$L1E=L1*(1-k**2)$$

W1 is the angular oscillation frequency with which current i2(t) oscillates with time, and L1E is the primary leakage inductance.

The additional factors that are considered in utilizing the above expression for the optimized coil in the CD circuit design for automobile applications are enumerated below:

1. The current oscillation frequency W1 should be preferably in the range of 10 to 30 KHz, corresponding to an oscillation period T1 between 100 and 33 microseconds. In this range the ignitability of the spark is optimized, i.e. for a gap in the range of 1 mm to 2 mm (0.040″ to 0.080″) there is a frequency effect of the spark which is optimized in this frequency range. The circuit component dielectric losses are also acceptable in this frequency range, although they cannot be ignored. Spark plug erosion is also reduced at the high frequency oscillation.
2. The size for capacitor 4 (C1) which is practical for automobile ignition systems is in the range of one to ten microfarads (for voltage V1 of 320 to 560 volts).

The above factors suggest a primary inductance L1 of 1 to 4 millihenry (for a coupling coefficient k of 0.98 to 0.996), or more precisely a leakage inductance between 5 and 40 milliHenry.

Based on the above, two coil/CD optimal circuit designs were developed for the same input voltage and optimized turns ratio N, giving two different output voltages (high, and very high), which were then completed based on the efficiency optimization parameter EP. Below are the design parameters:

V0=V1=400 volts both cases;

C1=2.0, 8 microfarads;

L1=2.0, 1.0 millihenry;

N=40 turns both cases;

$L2=(N**2)*L1=1.6$, 3.2 Henry;

C2′=20 picofarads (pf) both cases;

C2=60 pf both cases;

k=0.990, 0.995;

which leads to the following values:

T1=56, 63 microseconds;

f1=18, 16 KiloHertz ($f1=1/T1$);.

DF=0.048, 0.012;

VP=1.9, 1.98;

V2=30, 36 kilovolts;

I2=2, 10 amps.

The above values of voltage and current obtained simultaneously in a compact construction coil (N=40) are substantially superior to prior art devices. Moreover, these examples demonstrate the versatility of the optimized coil/capacitor invention in providing favorable current/voltage values at the optimized oscillation frequency (about equal to 20 KHz). Also noteworthy is the ability to provide plasma jet like ignition through high current (10 amps) and wide gap firing (with 36 Kilovolts).

The above parameters are practical for a range of the coil capacitor combinations which can be readily implemented, and examples of which have been tested.

The other factors that must be specified are the coil 3 winding primary 1 and secondary 2 resistance values R1 and R2. This is done with reference to the efficiency parameter EP developed below:

$$P(R1)=\tfrac{1}{2}*R1*(N*I2)**2$$

$$P(R2)=\tfrac{1}{2}*R2*(I2)**2$$

$$P(\text{arc})=0.707*Varc*I2$$

where

P(X) indicates the power dissipated in element X when a sinusoidal current with peak I2 flows through X.

The efficiency parameter EP is defined according to:

$$EP=[P(R1)+P(R2)]/P(\text{arc})$$

which is the ratio of the power dissipated in the coil resistances 11 and 12 to that delivered to the arc in gap 9. This implies a coil/CD system efficiency of 50% for EP=1. Other losses such as core losses are negligible, and the energy stored in the coil output capacitance E(C2) is ignored since it is available for ignition (spark gap breakdown) and is minimized by keeping C2' low. Also V2(t) is typically well below its peak value V2, and hence E(C2) is negligible. EP is thus given by:

$$EP = [(R2 + (N^{**}2)^{*}R1)^{*}(I2)]/1.4^{*}Varc$$
$$= [R^{*}(I2)^{**}3/2]/K$$

where R and K have been defined earlier.

Optimization with respect to EP can now be specified for the case above for a very high value of K of 150 (high spark current and wide spark gap 9 under compression):

$$EP=[R^{*}(2)^{**}3/2]/150=1$$

$$R=150/2.8=54 \text{ ohms}$$

which can be attained by picking:

R2=22 ohms

R1=0.02 ohms since $(N^{**}2)^{*}R1=1600^{*}0.02=32$ ohms

Figure 3:
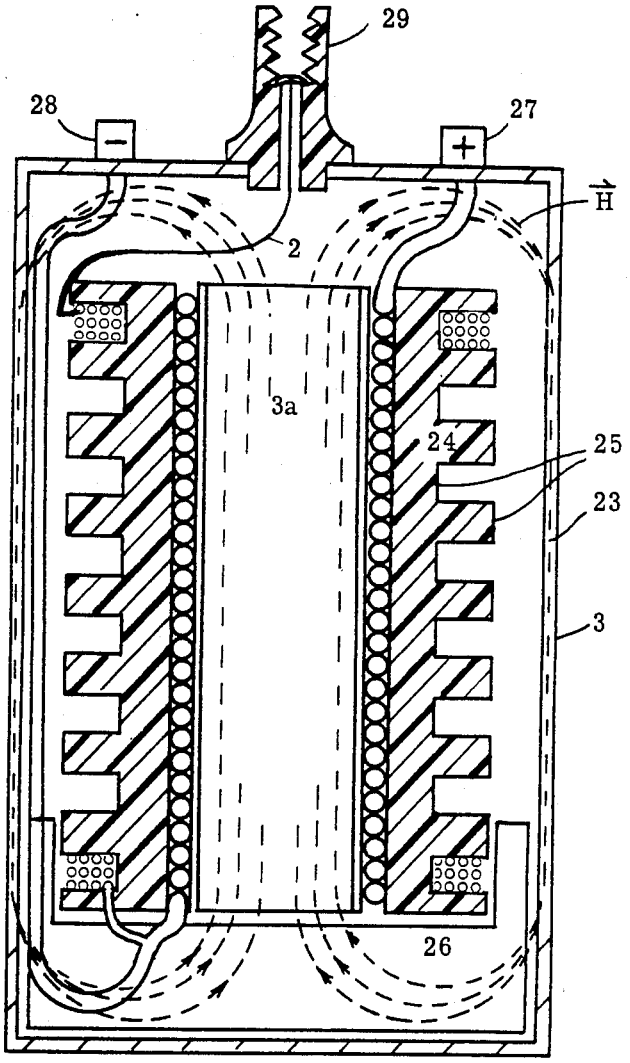
FIG. 3 depicts a preferred embodiment of the optimized coil characterized by a simple cylindrical shape and a sectioned coil secondary winding to minimize the output capacitance C2'.

The optimized coil for the specified input and output voltages, peak secondary current and oscillation frequency is thus specified and found to be in the realm of practicality, and will now be disclosed with reference to FIG. 3.

FIG. 3 depicts an optimized ignition coil 3 designed to have a simple cylindrical shape, very low output capacitance C2', and to satisfy the optimization criteria developed above. The core 3*a* (preferably a ferrite) is a cylinder of square or round cross-sectional area approximately equal to one square inch with length approximately equal to four inches. The core 3*a* is surrounded by primary winding 1 of turns approximately equal to 25 (20–30) of wire in the range of size 10 to 14, preferably composed of stranded magnet wire known as Litz wire, to minimize high frequency skin effect. 28 turns of No. 12 wire size will give a resistance equal to 0.02 ohms as specified in the above optimization criterion.

The primary winding 1 is surrounded by an electrical insulating segmented form 24 (e.g. plastic, paper, etc.) on which coil secondary winding 2 is wound as depicted. Form 24 has segments 25 about equal to 8 in number (4–12) on which wire in the range of size 22 to 26 is wound. For secondary winding wire 2 of size 24 and 1000 turns (n1=25 and N=40), core 3*a* of length of 4", and eight segments 25, the recommended width W and height H are these parameters is approximately equal to 20 Ohms (16–24 ohms), again satisfying the above optimization criteria.

Depicted also in FIG. 3 is insulating centering holder 26 and magnetic field container 23 for forcing magnetic field lines H emerging from core 3*a* to close upon themselves as shown. The container 23 also functions as a container for the entire unit, with 27, 28, and 29 representing respectively coil minus or ground, coil positive primary (for applying primary high voltage), and coil high voltage output of voltage approximately equal to 30 Kilovolts.

Coil 3 is thus seen to differ substantially from existing ignition coils yet it is physically only about 50% larger. For cases where, for example, a very large plasma jet-like spark is desired, it is only necessary is to pick the coil capacitor parameters and to use a large capacitor C1 (say 20 ufarads) along with a large spark gap 6 (say 0.100") to achieve this. N can be chosen equal to 44, L1 equal to 1.25 millihenry, k equal to 0.994 and only 22 turns of primary No. 10 wire used (with the optimization criteria VP and EP remaining satisfied). With these values on can easily produce a plasma jet of greater than 10 amps peak current and 80 microseconds duration (for a voltage approximately equal to 400 volts).

Figure 4:
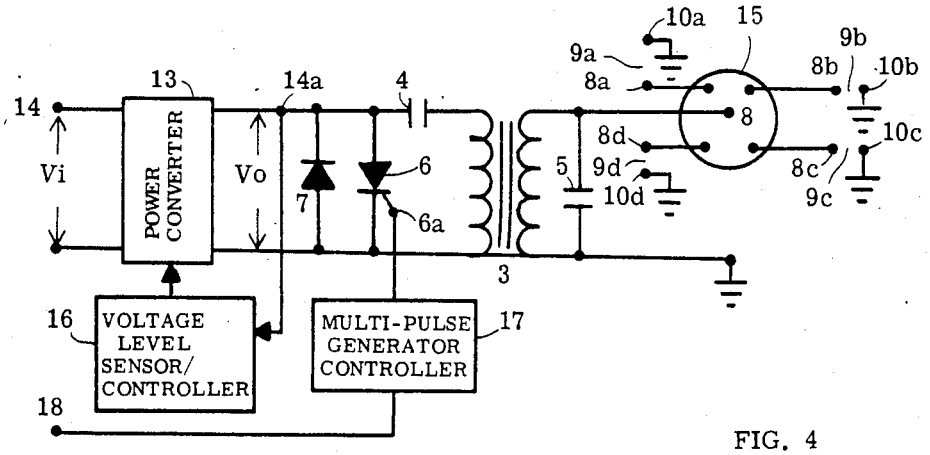
FIG. 4 depicts the circuit of FIG. 2 used as an ignition system for a four cylinder IC engine. In addition to the necessary inverter power supply are shown the output voltage level sensor-controller and multi-pulse generator/controller making up the power supply/control box.

FIG. 4 depicts the application of the optimized coil/CD system to a four cylinder IC engine. The key features of the optimized power supply/controller, which is the subject of patent application Ser. No. 688,036 is also shown, namely the power inverter with controlled turn-off 13, the voltage level sensor 16, and the multi-phase generator/controller 17.

In this application secondary output 8 is connected to distributor 15 which sequentially distributes the ignition pulses to each spark plug gap 8*a*/10*a*, 8*b*/10*b*, 8*c*/10*c*, and 8*d*/10*d*, where 10*a*, 10*b*, 10*c*, and 10*d* are ground points (typically engine block). Points 9*a*, 9*b*, 9*c*, 9*d* are the spark gaps respectively. Assuming four stroke engine operation, then at 6,000 RPM (highest engine speed) the time between ignition pulses is 5 milliseconds.

The inverter 13 power supply requirements can be specified with respect to the optimized coil/CD system by analyzing the two cases of the high RPM condition (assuming Vi=14 volts), and the engine cranking condition (Vi=8 volts). For this analysis, we assume that optimally one specifies a spark made up of a pulse train of width between 0.5 msec and 5 msec, with a pulse firing rate of five pulses per millisecond.

Beginning with the 6,000 RPM condition, it is assumed that five pulses are used for a 1 millisecond duration defined as T2, which gives four milliseconds as the time available to recharge C1 (defined as Ti). The initial energy stored in capacitor C1 is:

$$E(C1i)=\tfrac{1}{2}{}^{*}C^{*}V0^{**}2$$

$E(C1i)$=160 millijoules for C1=2 uF and V0=400 volts.

The power supply criterion is defined as the output power needed to totally recharge CI assuming it to be totally uncharged, i.e.

$$Vi^{*}Ii=E(C1i)/Ti$$

which for a battery voltage Vi of 14 volts gives a battery current $$Ii=0.160/(14^{*}0.004)=3 \text{ amps}$$

The engine cranking condition which the current must satisfy is that it must provide sufficient power in the recharge time between pulses to provide an energy equal to that dissipated in a single pulse when the voltage is down to half its initial value (of the fully charged capacitor), i.e. it must provide one quarter the energy. For the above case of five pulses per millisecond with a 68 microsecond oscillation period T1 (giving a pulse duty cycle of 34%), gives a recharge time T3 of 132 microseconds. For EP=1, the total power dissipated per pulse P(tot) is:

$$P(tot)=2*K/SQRT(I2)$$

and the total energy E(tot) dissipated per pulse is:

$$E(tot)=P(tot)*T1.$$

For the case presented above K=150 and I2=2 amps, i.e. the peak values, we obtain:

$P(tot)=212$ watts, $E(tot)=15$ millijoules.

The energy delivered in the recharge time T3 by the battery is:

$E(bat)=Vi*Ii*T3$ $E(bat)=8*3.6*0.132$ millijoules $E(bat)=3.8$ millijoules which is seen to be equal to one quarter the peak energy and thus satisfy the low RPM condition.

The actual pulse train period at the low RPM condition can be specified with some arbitrariness. A practical range is 2.5 to 7.5 msecs (i.e. about equal to 5 msec), which drops to one msec or less at 6,000 RPM.

Figure 5:
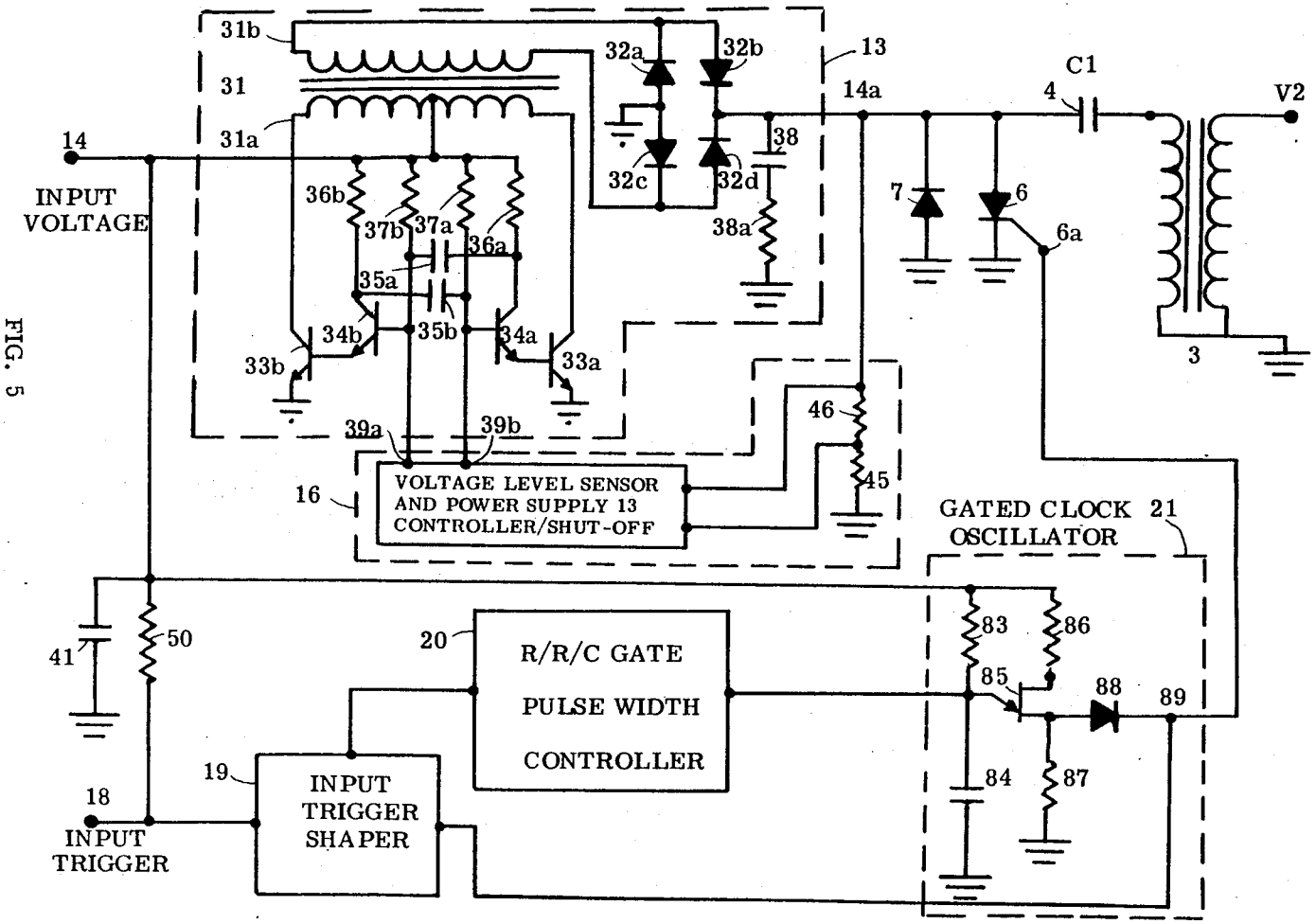
FIG. 5 is a detailed drawing of a preferred embodiment of the complete Pulsed Ignition system showing detailed features of the inverter power supply and gated clock oscillator.

FIG. 5 is a more detailed drawing corresponding to FIG. 4 excluding the spark distributing means 15. Key elements other than those described with reference to FIGS. 1 and 2 are the "gated power inverter 13", the "voltage level sensor and power supply 13 controller/-shut-off 16", the "universal input trigger shaper 19", the "gate pulse width controller 20" and the "gated clock oscillator 21".

Power inverter 13 is used for charging ignition capacitor 4 which is in series with ignition coil primary 1. SCR switching element 6 is closed to complete the series circuit from ground to the ignition capacitor 4 to ignition coil primary 1. SCR 6 triggering signal is provided from gate clock oscillator 21 which is responsive to the gate pulse width control circuit 20 enabling the clock 21 during the period of time the gate pulse width control 20 is in a high active state (the initial trigger is provided directly from 19). The gate pulse width control 20 is responsive to the universal input trigger converter 19 which conditions and shapes the signal from the ignition trigger means 18 which may be either mechanical breaker contacts or the output of current O.E.M. electronic ignition or any similar single positive trigger ignition timing means. In this way, when the ignition is activated and a signal is received at 18, a sequence of ignition pulses are provided for a period controlled by 20, which has been preselected and preset, and at a rate determined by 21 which has also been preset.

Voltage level sensor 16 turns off the gated power inverter 13 when the voltage at 14*a* reaches a preset value, e.g. 380 volts, and spark firing gate sensor of 16 inhibits gated power inverter 13 during the period of time when SCR 6 discharges capacitor 4 into ignition coil primary 1. In this way power inverter 13 can operate at its maximum possible efficiency and provide a constant output voltage over a range of input voltages Vi. Capacitor 4 and ignition coil 3 can thus be designed for a specific voltage independent of variations of the input voltage Vi.

Power inverter circuit 13 has been disclosed in detail in U.S. Pat. No. 3,898,971 assigned to the present assignee. The only relevent differences are that power transistors 33*a* and 33*b* are of the darlington type and output filter capacitor 38 has connected in series with it damping resistor 38*a*. Power inverter 13 can also be of the single power transistor flyback type or other which may be more efficient or otherwise more desirable.

Voltage sensor/controller 16 is disclosed in detail in patent application Ser. No. 688,036 of Ward and Lefevre filed of even date herewith and of common assignment. Resistors 45/46 are voltage dividing network for presetting output voltage 14*a*, and connecting points 39*a* and 39*b* are ones used to control (shut-off) power inverter 13. Unit 16 can also operate with other power inverter circuits than that shown herein to optimize efficiency and provide output regulation.

Input trigger shaper 19 and gate pulse width controller 20 are disclosed in detail in said patent application Ser. No. 688,036. Gated clock oscillator is disclosed in detail also in U.S. Pat. No. 3,898,971 excepting that initial trigger point 89 is added.

Figure 6A:
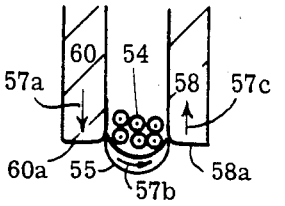
FIGS. 6 and 6*a* depict preferred embodiment of a spark plug for use with the high breakdown voltage/- high current output of the coil/capacitor invention, characterized by parallel, large gap electrodes optimized for large self magnetically moving spark plasma discharge.
Figure 6:
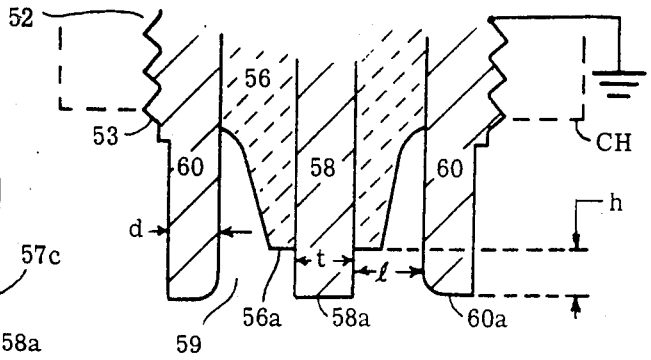

FIGS. 6 and 6*a* depict a spark plug firing end 52 (protruding from surrounding cylinder head structure CH) which makes use of the high voltage/high current capability of the Pulsed Ignition for producing a large moving plasma discharge. The plug end is of the extended type and comprises a center electrode 58 of thickness t preferably approximately 0.1 inch, insulating ceramic 56, and side electrodes 60 protruding beyond the thread end 53. The plug uses preferably several axial side electrodes (to minimize erosion) of typical cross-sectional dimension d and preferably in the range of 0.080–0.10 inches. The gap 59 of width 1 is preferably in the range of 0.060 to 0.120 inches, and will depend on several factors including compression ratio. The center electrode 58 preferably, and with distinct advantage, extends beyond the end 56*a* of ceramic insulator 56 by a height dimension h which is about equal to t. The orientation of the electrodes 58, 60 insures a maximum self magnetic field 54 (represented by dots in circles to show an outwards field direction perpendicular to the plane of the drawing) produced by arc currents 57*a*, 57*b*, 57*c* (whose direction is shown by arrows) for pushing the plasma arc 55 outwards and increasing its size and penetration. By so using the Pulsed Ignition's ability to fire a large gap 59 and to provide high current, the igniting plasma arc energy is distributed over the largest possible volume, is well exposed to the air-fuel mixture, and moved away from the plug tip 58*a*/60*a* to provide optimum lean mixture igniting ability while minimizing plug electrode 58/60 erosion and minimal interference by the ceramic 56.

The above described invention provides substantial improvement in ignition system technology by making possible an ignition system which can provide optimal efficiency, optimal igniting ability, and optimal ignition characteristics and which is simple, practical, low cost and easy to install and retrofit.

Since certain changes may be made in the above apparatus and method without departing from the scope of the invention herein involved, it is intended that all matter contained in the above description, or shown in the accompanying drawings shall be interpreted in an illustrative and not in a limiting sense.

What is claimed is:

1. In an electrical ignition system including a transformer with primary and secondary windings wound about a magnetic core material and an input capacitor of capacitance C1 connected to the primary winding for storing and discharging electrical energy, and secondary winding connected to a spark gap providing a total secondary output capacitance C2, the improvement comprising:

the transformer winding turns ratio N being constructed between 25 and 55 to provide a peak secondary output voltage V2 for an input voltage V1 to which capacitor C1 is charged, where V2 is given by V2=k1*N*V1*VP, where k1 is the coil coupling coefficient and VP is the voltage doubling parameter defined according to $VP=2/[1+(N^{**}2)^{*}C2/C1]$, and the system is constructed and arranged so that the voltage doubling parameter VP is greater than 1.6.

2. The system defined in claim 1 wherein the turns ratio N is between 35 and 45 and VP is greater than 1.8.

3. The system defined in claim 1 wherein the primary winding and capacitor are connected to an electrical power supply for charging said capacitor to voltage V1 and wherein means are provided for discharging said capacitor to form an arc, in the secondary circuit, across said a spark gap with a peak current I2, the transformer being constructed with a through resistance R which is given by $R=R2+((R1)(N^2))$, where R1 and R2 are the coil primary and secondary winding resistances respectively, such that the coil efficiency parameter EP is no greater than 2, where EP is given by $EP=((R-)(I2^3)/2)(K)$, where K is the arc characteristic constant given by $K=(1.4)(Varc)(I2^{\frac{1}{2}})$, and Varc is the arc burning voltage across the spark gap which depends on the current I2.

4. The system defined in claim 3 constructed and arranged so that EP is less than 1.

5. The system defined in claim 3 constructed and arranged so that the peak attainable output voltage V2 is at least 27 Kilovolts.

6. The system defined in claim 3 wherein the spark current oscillation frequency W1 is between 10 and 30 KiloHertz.

7. The system defined in claim 3 constructed and arranged so that V2 is at least 30 kilovolts and the peak current I2 is at least 2 amps.

8. The system defined in claim 7 wherein voltage V1 is no greater than 400 volts.

9. The system defined in claim 8 constructed and arranged so that I2 is greater than 4 amps.

10. The system defined in claim 7 wherein the gap across which the arc is struck is a pressurized internal combustion engine type spark gap greater than 0.055 inches.

11. The system defined in claim 10 wherein said gap is greater than 0.075 inches.

12. The system defined in claim 3 in combination with an internal combustion engine containing combustible mixture in region of the spark gap and constructed and arranged so that a pulse train of greater than one ignition spark is formed per mixture firing wherein the sum of the peak currents of subsequent sparks of the pulse train is greater than the initial peak current excepting where only two sparks per pulse train are used.

13. An ignition transformer with primary and secondary windings wound about a magnetic core with primary turns about equal to 20 turns and total primary wire resistance R1 less than 0.1 ohm, total secondary resistance R2 less than 100 ohm and a secondary to primary turns ratio N about equal to 40.

14. The transformer defined in claim 13 constructed and arranged so that said magnetic core has a cross sectional area of approximately 1 square inch and length approximately 4 inches and through resistance R less than 160 ohms.

15. The transformer defined in claim 14 wherein R is less than 80.

16. The transformer defined in claim 14 wherein the secondary winding to ground capacitance C′ is less than 25 picofarads.

17. The transformer defined in claim 16 wherein R is less than 100 and primary leakage inductance L1E is less than 16 microhenry.

18. A high voltage output 25–40 Kilovolts, low secondary capacitance C′, low through resistance R transformer comprising in combination:

(a) means defining a low resistance large diameter primary wire wound about a magnetic coil former core with a primary leakage inductance less than 1 millihenry;

(b) means defining a secondary low resistance, large diameter wire wound around an electrically insulating secondary coil former, concentric with primary winding, and segmented along its length into stacked annular pie segments;

(c) means defining a magnetic outside thin field guide acting also as a container for the entire unit;

wherein one end of said secondary winding is connected to a high voltage insulated terminal and its other end is connected to one end of said primary winding and brought out to a ground terminal, other end of said primary winding brought out to another terminal, the high terminal, to which electrical power is applied.

19. The transformer defined in claim 18 wherein the primary wire is wire of gauge AWG between 10 and 16 and secondary wire is wire of gauge AWG between 22 and 28 and output capacitance C′ is less than 25 picofarads.

20. The transformer defined in claim 19 wherein the high terminal of the primary winding is connected to a capacitor of 1 to 20 microfarads and the high voltage insulated terminal is connected to a spark gap.

21. The system defined in claim 19 wherein said spark gap is formed by a spark plug firing end, said end comprising extended axial electrodes defining a large spark gap and a large essentially rectangular magnetic forming circuit for moving the spark plasma at spark gap away from the tips of the electrodes.

22. The system of claim 21 wherein the gap distance is greater than 0.055 inches.

23. The system defined in claim 20 wherein said transformer is used as an ignition coil in an IC engine operating with a lean cruise condition air-fuel ratio in excess of 18 to 1.

24. In an electrical ignition system including a transformer with its primary winding connected to a capacitor of capacitance C1 and secondary winding connected to a spark gap across which is a total capacitance C2, the improvement comprising a turns ratio N and construction providing a voltage doubling parameter VP of value greater than 1.8, where $VP=2/(1+N^2(C2)/(C1))$.

25. The system defined in claim 24 wherein through resistance R of primary and secondary windings is less than 200.

26. The system defined in claim 24 wherein the turns ratio N is in the range of 15 to 60.

27. The system defined in claim 26 wherein the peak secondary winding voltage V2 impressed across the spark gap is greater than 20 Kilovolts.

28. The system defined in claim 27 wherein V2 is in the range of 24 to 32 Kilovolts.

29. The system defined in claim 28 wherein the through resistance R is less than 100 ohms and wherein the capacitor connected to the primary winding is charged to a peak voltage V1 in the range of 300 to 1000 volts to provide a specified voltage V2 in said range.

30. The system defined in claim 29 wherein the total output capacitance existing between the coil secondary and ground is greater than 100 picofarads.

31. The system defined in claim 30 wherein said total output capacitance is greater than 200 picofarads.

32. The system defined in claim 30 wherein input voltage V1 is equal to 360 volts and capacitance of capacitor C1 is approximately equal to 8 uf.

33. The system defined in claim 30 wherein input voltage V1 is approximately equal to 600 volts and capacitance of capacitor C1 is about equal to 3 uf.

34. The system defined in claim 30 wherein input voltage V1 is approximately 1000 volts and C1 is about equal to 3 uf.

* * * * *